US011130139B2

(12) United States Patent
Kemp et al.

(10) Patent No.: US 11,130,139 B2
(45) **Date of Patent: *Sep. 28, 2021**

(54) WASTE DESTRUCTION DEVICE FOR SHARPS, NEEDLES AND SOLID WASTE

(71) Applicants: Safe Medical Technology, Inc., Mansfield, OH (US); Elizabeth Kemp, Hartland, WI (US)

(72) Inventors: Elizabeth Kemp, Oconomowoc, WI (US); Mark Davis, Mansfield, OH (US)

(73) Assignees: Elizabeth Kemp, Oconomowoc, WI (US); SAFE MEDICAL TECHNOLOGIES, INC., Mansfield, OH (US)

( * ) Notice: Subject to any disclaimer, the term of this patent is extended or adjusted under 35 U.S.C. 154(b) by 54 days.

This patent is subject to a terminal disclaimer.

(21) Appl. No.: 16/691,723

(22) Filed: Nov. 22, 2019

(65) Prior Publication Data

US 2021/0053071 A1 Feb. 25, 2021

Related U.S. Application Data

(63) Continuation of application No. 15/134,121, filed on Apr. 20, 2016, now Pat. No. 10,537,898.
(Continued)

(51) Int. Cl.
*B02C 19/00* (2006.01)
*B02C 18/14* (2006.01)
(Continued)

(52) U.S. Cl.
CPC ..... *B02C 19/0075* (2013.01); *B02C 18/0007* (2013.01); *B02C 18/142* (2013.01); *B02C 18/145* (2013.01); *B02C 18/16* (2013.01)

(58) Field of Classification Search
CPC ..... B02C 19/0075; B02C 18/2216; B02C 18/182; B02C 18/186; B02C 18/00; B02C 18/02; B02C 18/04; B02C 18/06; B02C 18/08; B02C 18/086; B02C 18/14; B02C 18/141; B02C 18/142; B02C 18/143; B02C 18/144; B02C 18/145; B02C 18/146;
(Continued)

(56) References Cited

U.S. PATENT DOCUMENTS 2,008,049 A 7/1935 Staude
4,809,915 A 3/1989 Koffsky et al.
(Continued)

*Primary Examiner* — Matthew Katcoff
(74) *Attorney, Agent, or Firm* — Donald J. Ersler

(57) ABSTRACT

A waste destruction device for sharps, needles and solid waste preferably includes a material intake member, a destruction device and a storage member. The material intake member includes an intake housing and an intake cover. The intake cover pivots from an open to a closed orientation to receive objects to be shredded. At least one microprocessor board is used to control devices of the waste destruction device. The waste destruction device preferably includes a cutter housing, a first cutter member, a second cutter member, a cutter motor and a cutter intake housing. The waste destruction device preferably contains disinfection devices for disinfecting thereof. The storage member preferably includes a storage housing, a container drawer and a waste container. The container drawer is slidably received by the storage housing.

14 Claims, 12 Drawing Sheets

Related U.S. Application Data

(60) Provisional application No. 62/150,121, filed on Apr. 20, 2015.

(51) Int. Cl.
*B02C 18/16* (2006.01)
*B02C 18/00* (2006.01)

(58) Field of Classification Search
CPC ..... B02C 18/148; B02C 18/16; B02C 18/162; B02C 18/18; B02C 18/22; B02C 18/2225; B02C 18/2291; B02C 18/2266
See application file for complete search history.

(56) References Cited

U.S. PATENT DOCUMENTS 5,340,003 A 8/1994 Wilson
5,340,039 A 8/1994 Lefevre
5,354,000 A * 10/1994 Wright ..... A61L 11/00 241/100
5,620,654 A * 4/1997 Mosenson ..... B02C 19/0075 422/28
5,683,044 A 11/1997 Gueldenpfennig et al.
5,887,807 A * 3/1999 Beinecke ..... A61L 11/00 241/36
6,186,428 B1 2/2001 Robinson et al.
6,641,006 B2 11/2003 Kamiya
6,983,903 B2 * 1/2006 Chang ..... B02C 18/0007 241/236
7,198,213 B2 4/2007 Kolbet et al.
7,578,460 B2 * 8/2009 Berger ..... E03C 1/2665 241/46.014
7,661,614 B2 * 2/2010 Matlin ..... F16P 3/145 241/37.5
7,926,749 B2 * 4/2011 Santandrea ..... B02C 18/2225 241/24.11
8,070,082 B2 * 12/2011 Sued ..... B02C 18/0007 241/37.5
8,215,575 B2 * 7/2012 Palin ..... B02C 23/02 241/135
8,770,503 B2 * 7/2014 Weidman ..... B02C 18/142 241/35
10,792,667 B2 * 10/2020 Chang ..... B02C 25/00
2007/0246582 A1 10/2007 Aries et al.
2008/0011888 A1 1/2008 Dziesinski et al.
2008/0149224 A1 6/2008 Kappel et al.
2010/0327091 A1 * 12/2010 Ko ..... B02C 18/0007 241/25
2013/0015280 A1 * 1/2013 Tamaki ..... B02C 18/0007 241/236
2014/0209718 A1 * 7/2014 Bevins ..... B09B 5/00 241/24.11
2016/0318033 A1 * 11/2016 Hengl ..... B02C 18/142

* cited by examiner

WASTE DESTRUCTION DEVICE FOR SHARPS, NEEDLES AND SOLID WASTE

CROSS-REFERENCES TO RELATED APPLICATIONS

This is a continuation in part patent application, which takes priority from patent application Ser. No. 15/134,121, filed on Apr. 20, 2016, now U.S. Pat. No. 10,537,898, issued on Jan. 21, 2020, which claims the benefit of provisional patent application No. 62/150,121 filed Apr. 20, 2015, which are hereby incorporated by reference in their entirety.

BACKGROUND OF THE INVENTION

Field of the Invention

The present invention relates generally to a device and method for processing medical waste and more specifically to a waste destruction device for sharps needles and medical solid waste, which processes medical waste, such that it may be discarded as normal garbage.

Discussion of the Prior Art

The risk of health problems associated with the destruction and decontamination of medical waste are well-known throughout the world. Syringes, plastic blood bags, metal clips, hoses, etc. present formidable problems for disposal. Not only are they difficult to deal with due to safety risks to handlers and health compliance regulations, but also they are contaminated with viral and bacterial pathogens, which make their handling hazardous. These items must be decontaminated, rendered harmless and disposed of to prevent the transmission of disease, and to avoid accessibility of used needles and syringes and for purposes of general sanitation.

Devices adapted for the disposal of hospital waste are known. However, they suffer from a number of limitations, such as safety problems, including leaks and other shortcomings, which make them not particularly suitable to institutional applications where relatively unskilled workers are employed as operators. Moreover, since these devices are employed for the disposal of glass, plastic and other implements, the wear and tear on the devices is considerable. The users are generally incapable of keeping the devices in proper adjustment to avoid damage. They thus require either the presence of a skilled mechanic on staff or frequent calls by the manufacturer's skilled service mechanic.

Since the advent of the disposal syringe and other disposable medical articles, there has also arisen a need for a method to prevent their misuse and theft. In hospitals today there is a tremendous volume of these articles, which after being used, must be accounted for by some method or another, all of which takes precious time. There is an ever-growing problem with theft of used syringes for illegal intra-venous drug use and/or for drug diversion. There is also a world-wire increase in the generation of sharps, needles and medical waste from such diseases as cancer and diabetics.

Typically, syringes and needles are simply thrown into sharps containers and stored until the containers are collected by waste processing and disposal personnel of a facility. Storage of whole syringes and needles also pose safety risks for waste disposal collection personnel. There exists the possibility of containers breaking and collection personnel accidentally getting stuck with contaminated needles. The department of transportation requires insurance for needle exchange programs, because handlers of the used needles may be stuck.

Accordingly, it is a clearly felt need in the art to provide a destruction device for sharps, needles and solid waste, which processes medical waste, such that it may be discarded as normal garbage; is sanitary; safe to use; can process large volumes of needles and syringes on; preferably on the same site where the waste is generated; and which will provide a device for the disposal of home generated needles, sharps and medical waste instead of the waste being discarded into a trash can.

SUMMARY OF THE INVENTION

Provided is a waste processing device comprising a housing having an upper region and a lower region, a material intake member and cutting region located in the upper region, a pair of elongate counter-rotational cutting members located within the cutting region carrying a plurality of cutters having cutting teeth mounted at different angular positions relative to adjacent cutters, means to drive the pair of elongate cutting members.

According to certain embodiments, disclosed is a waste processing device comprising a housing having an upper region and a lower region and including an antimicrobial additive, a material intake member and cutting region located in the upper region, a pair of elongate counter-rotational cutting members located within the cutting region carrying a plurality of cutters having cutting teeth mounted at different angular positions relative to adjacent cutters, and means to drive the pair of elongate cutting members.

According to certain embodiments, disclosed is a waste processing device comprising a housing having an upper region and a lower region, a material intake member and cutting region located in the upper region, a pair of elongate counter-rotational cutting members located within the cutting region carrying a plurality of cutters having cutting teeth mounted at different angular positions relative to adjacent cutters, means to drive the pair of elongate cutting members, and a vacuum for extracting material generated during operation of said device.

According to certain embodiments, disclosed is a waste processing device comprising a housing having an upper region and a lower region, a material intake member and cutting region located in the upper region, a pair of elongate counter-rotational cutting members located within the cutting region carrying a plurality of cutters having cutting teeth mounted at different angular positions relative to adjacent cutters, means to drive the pair of elongate cutting members, and a filter for filtering the internal atmosphere of said device.

According to certain embodiments, disclosed is a waste processing device comprising a housing having an upper region and a lower region, a material intake member and cutting region located in the upper region, a pair of elongate counter-rotational cutting members located within the cutting region carrying a plurality of cutters having cutting teeth mounted at different angular positions relative to adjacent cutters, means to drive the pair of elongate cutting members, a vacuum for extracting air particles generated during operation of said device; and a filter for filtering the internal atmosphere of said device.

The present invention provides a waste destruction device for sharps, needles and solid waste, which processes medical waste, such that it may be discarded as normal garbage. The waste destruction device for sharps, needles and solid waste (waste destruction device) preferably includes a material intake member, a destruction device and a storage member. The material intake member includes an intake housing and an intake cover. A cover opening is formed through the intake housing and is sized to receive the intake cover. The intake cover preferably includes a semi-circular shape and two end walls, which form an internal cavity. The two end walls of the intake cover are pivotally engaged with two opening end walls of the cover opening. The intake cover in an open orientation allows waste to drop through the cover opening to the destruction device. A motor is preferably used to rotate the cover from an open orientation to a closed orientation.

At least one microprocessor board is used to control devices of the waste destruction device. The microprocessor board can set multiple defaults and additional features such as running time, troubleshooting and error codes for an object placed into the cover opening that would damage the cutting members.

The waste destruction device preferably includes a cutter housing, a first cutter member, a second cutter member, a cutter motor and a cutter intake housing. The cutter housing rotatably retains each end of the first and second cutter members. A gear train causes the first and second cutter members to have counter rotation relative to each other. The gear train is driven by the cutter motor. The cutter intake housing guides waste into the into the first and second cutter members.

The storage member preferably includes a storage housing, a container drawer and a waste container. The storage housing includes a drawer opening. The drawer opening is sized to receive the container drawer. The container drawer is slidably received by the storage housing. The container drawer includes a base member, a front member, a container retaining boss [item 272] and a handle. The front member extends upward from a front edge of the base member. The retaining boss extends upward from the base member. An inside perimeter of the retaining boss is sized to receive the waste container.

The user deposits several objects into the intake cover. The user then waves their hand over the touch less switch to close the intake cover. The several objects are shredded by the first and second cutting members and fall into the waste container.

DETAILED DESCRIPTION OF THE PREFERRED EMBODIMENTS

Figure 1:
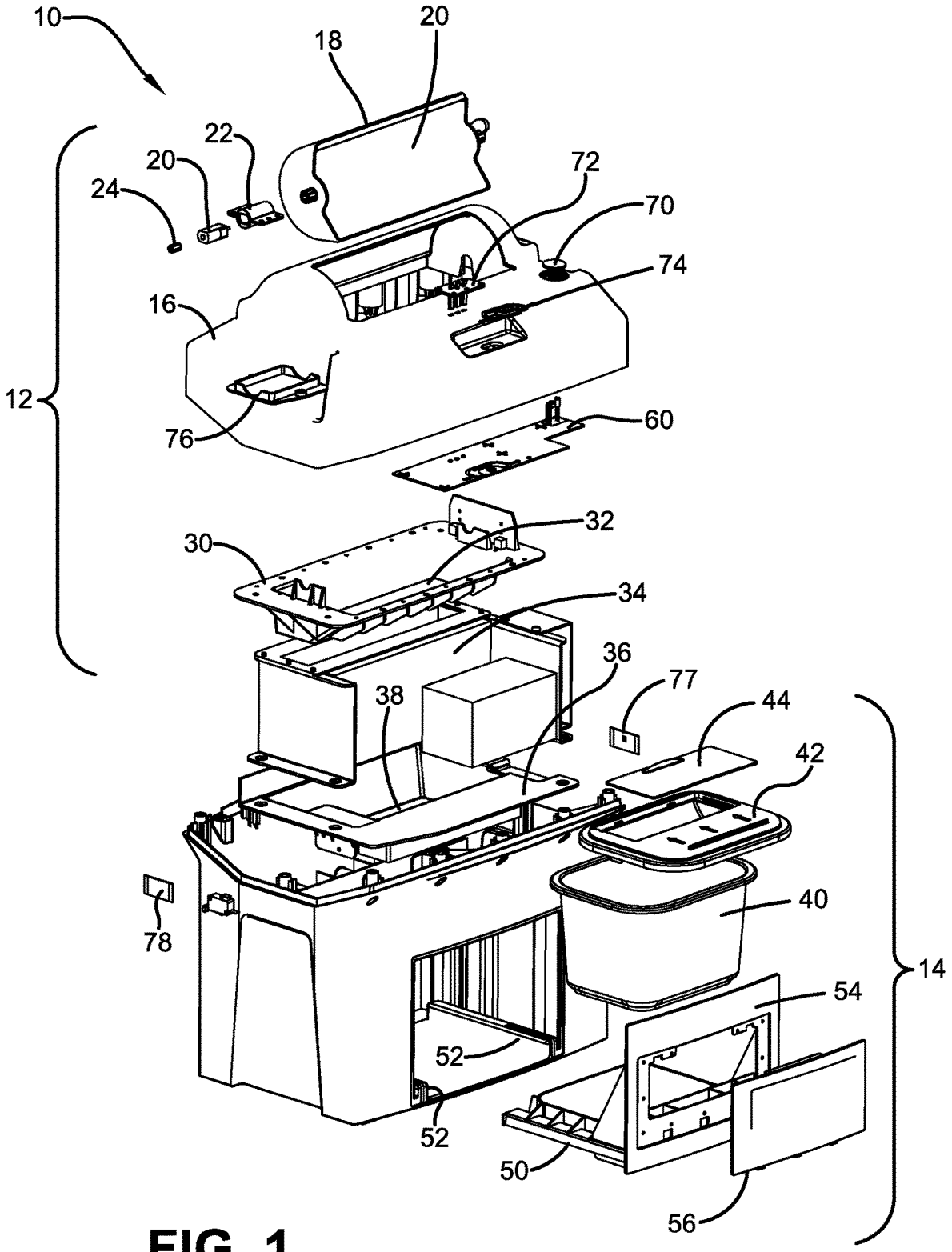
FIG. 1 is an exploded perspective view of an illustrative embodiment of the waste processing device.

The disclosure relates to a device for shredding waste and method for reducing the volume of waste material. Provided is a device for processing waste, such as medical and hospital waste. The device comprises an outer housing, a material intake chamber defining a passageway and having an opening that communicates with the atmosphere and with the interior of the housing. A cutting member is contained within the housing for cutting and shredding waste that has been inserted into the material intake chamber of the device. The device includes a motor to drive the cutting members.

The housing of the device includes an upper region and a lower region that is located below the upper region. The upper region of the device includes a top wall. The material intake member is located in the top wall of the housing. The material intake member comprises an elongate member that extends horizontally along the top wall of the housing. The material intake member comprises a cavity for accepting medical waste to be processed.

According to certain illustrative embodiments, the material intake member comprises a horizontal tray-like member that has a suitable cavity for accepting one or more medical syringes that are placed into the tray in a substantially horizontal position for processing. According to one embodiment, the material intake member is driven by an electric motor and is capable of opening and closing to accept waste material to be processed.

According to other embodiments, the material intake member is operated by an uninterrupted power supply (UPS). Without limitation, and only by way of example, the battery of the UPS may be trickled charged by solar energy or charged by AC power.

The cutting region of the device is located in the upper region of the housing. The cutting members of the device are located within the cutting region for shredding waste that has entered the housing from the material intake tray. Positioned between the lower portion of the material intake tray and the cutting members is an upper horizontal wall that separates the material intake tray from the cutting members. The upper horizontal wall includes an opening or chute for transferring waste to be processed from the material intake tray to the cutting members located in the cutting region.

The device includes a pair of elongate rotatable cutting members that are located in the cutting region of the housing. The cutting members are located substantially in the same horizontal plane and are arranged for counter-rotation relative to one another. Each of the elongate cutting members comprise a plurality of spaced-apart cutters that are mounted on rotatable shafts. Each of the cutters are substantially circular in shape and have a plurality of cutting teeth extending radially from the outer circumference of the cutter. The cutters on each of the rotating shafts are axially separated from adjacent axial cutters along the longitudinal axis of the cutting members.

The cutters of the cutting members are offset along the longitudinal axis of the cutting members from the cutters of the other cutting member. As the pair of rotatable cutting members counter-rotate relative to one another during the waste shredding process, the cutters on one of the cutting members may pass through the axial separation of the adjacent cutters carried on the other of the cutting member of the pair of rotatable cutting members. Each of the cutters of the cutting members are mounted on the rotatable shaft so that immediately adjacent cutters do not have cutting teeth in the same angular position. The mounting of the cutters on the rotatable shafts in this manner forms a helical pattern of cutting teeth along the longitudinal length of each of the cutting members.

According to certain illustrative embodiments, each of the rotatable cutting members includes at least one row of cutting teeth extending in a substantially helical pattern along at least a portion of the longitudinal axis of the rotatable cutting member. According to other illustrative embodiments, each of the rotatable cutting members includes at least one row of cutting teeth extending in a substantially helical pattern along substantially the entire length of the longitudinal axis of the rotatable cutting member.

According to other illustrative embodiments, each of the rotatable cutting members includes at least one row of cutting extending in a substantially helical pattern along the entire length of the longitudinal axis of the rotatable cutting member.

According to certain illustrative embodiments, each of the rotatable cutting members includes a plurality of rows of cutting teeth extending in a substantially helical pattern along at least a portion of the longitudinal axis of the rotatable cutting member. According to other illustrative embodiments, each of the rotatable cutting members includes a plurality of rows of cutting teeth extending in a substantially helical pattern along substantially the entire length of the longitudinal axis of the rotatable cutting member.

According to other illustrative embodiments, each of the rotatable cutting members includes a plurality of rows of cutting teeth extending in a substantially helical pattern along the entire length of the longitudinal axis of the rotatable cutting member.

The cutting members extend between spaced-apart mounting brackets, are carried by a shaft, and are driven by an electric motor. The cutters are also specially designed with specific angular adjustments to adapt to small and large objects through adjustment with an adjustment pin. The cutters may also be self-sharpening and self-lubricating.

Each of the cutting members include a specific angular design. Each cutting tooth of the cutters has a first surface that extends outwardly from the outer circumference of the cutter at a 90° angle from the point on the surface from which it emanates and a second surface that extends outwardly from the outer circumference of the cutter at a 70° angle from the point on the surface from which it emanates, until it meets the end of the first surface. The angular design of the teeth of the cutters have an auger effect on the syringes, thereby pulling the syringe into the cutting members substantially horizontally as opposed to vertically.

According to certain embodiments, the device may include an electric motor to rotate cutting members. The electric motor may be powered by batteries or any other source of suitable electric current. The motor may rotate the cutting member(s) about their respective rotary axes at variable rotational speeds and in reverse. The device may also include a timed stopping mechanism to shut off the motor after a pre-determined period of time. According to further embodiments, the means to drive the cutting members may be powered by any international power source.

A lower horizontal wall divides the upper and lower portions of the housing of the device. The lower horizontal wall includes an opening or chute to permit shredded medical waste to move from the cutting region into the collection member located in the lower region of the housing. Positioned below the cutting region is the lower collection region where the processed medical waste material is collected. The lower collection region of the housing includes a retractable tray for carrying a collection member, such as a bio-hazard sharps container. The retractable tray is engaged with spaced-apart mounting rails that permit the tray to be retracted and re-inserted into the lower region of the housing. The front wall of the housing includes a handle for retracting and inserting the tray into the housing. The sharps collection container contained in the lower region of the waste processing device may be locked with a suitable locking mechanism for security and safety purposes.

According to illustrative embodiments, the device further comprises a fan and air filter system. A filter member may be utilized in fluid connection with the fan to remove contaminants from the medical waste being processed in the inside environment of the housing. Without limitation, and by way of illustration, the device may utilize chemical, deep pleated, electronic, fiberglass or polyester, HEPA, ordinary flat or pleated, permanently charged electrostatic and washable/reusable filters.

According to other illustrative embodiments, the filter comprises a HEPA filter. The filter and fan may be positioned on the rear wall of the system with the fan being positioned exteriorly from the filter frame to draw air from the interior of the housing through the filter member.

The filtering system the filtering member consumes potentially contaminated air during every waste shredding sequence carried out of the device. The vacuum filtering system ensures that no potentially hazardous airborne aerosols generated during the shredding process are emitted to the environment outside of the housing of the device. According to alternative embodiments, a vacuum pump may be utilized to move air in or out of the device for the purpose of extracting gas, particles or vapor that may be emitted from the waste material. Without limitation, and by way of illustration, the device may be comprised of vacuum pumps, such as positive displacement pumps, momentum transfer pumps, molecular pumps and entrapment pumps.

The walls of the housing may include an anti-microbial additive to minimize or eliminate microbes that may be present in the medical waste being shredded by the device. For example, and without limitation, the anti-microbial additive may be provided in the form of imbedded coating that is applied to the inner wall surfaces of the material intake chamber. Alternatively, the anti-microbial additive may be an incorporated into the walls of the material intake chamber itself. For example, the walls of the material intake chamber may be comprised of a plastic material with the antimicrobial additive incorporated therein. Without limitation, the anti-microbial agent may be a silver-containing compound or composition.

Provided is a method for processing waste with the waste processing device. The device includes a hands-free activation of the material intake member that utilizes a sensor comprising a light emitting diode that emits infrared radiation, ie, infrared LED or IR-LED. In the event that the hands-free activation of the material intake member fails, the device includes a redundant activation back up comprising a push button activation.

Once the syringe(s) to be processed have been placed into the material intake member, the material intake tray is activated and rotates along its longitudinal axis 20 to drop the syringes to be processed in a horizontal fashion through the chute in the upper into the cutting region. In the cutting region of the housing, then syringes are shredded by the two elongate cutting members and the shredded material exits the cutting region through the lower horizontal wall and drops into the collection unit positioned in the lower portion of the housing.

According to certain illustrative embodiments, the position of the elongated rotatable cutting members relative to one another may be adjusted to accept small, large, or even extra-large waste objects to be shredded. According to these embodiments, one of the opposed rotatable cutting members of the pair of elongated rotatable cutting members is spring-loaded. The other opposed rotatable cutting member of the pair of elongated cutting members is not spring-loaded, but remains rotatable in its fixed longitudinal axis. The elongated spring-loaded cutting member is engaged on both opposite longitudinal ends with a bolt, spring and tensioner. The spring-loaded cutting member permits the space or width between the cutting teeth carried by the two opposed cutting members to be adjusted. The tension on the spring may be adjusted by the operator to permit a desired forward and backward movement of the spring-loaded cutting member, thereby adjusting the width between the cutting teeth of the spring loaded cutting member and the non-spring loaded cutting member to accommodate larger objects. The spring-loaded cutting member also permits the angles of the cutting teeth carried by the cutting members to be rotated in multiple degrees, relative to one another, to accommodate larger materials.

The waste processing device further includes a sensor to indicate to the user when the waste collection container located in the lower region of the housing of the device is full and cannot accept additional shredded materials. The device includes an audibly and/or visually perceptible signal to alert or otherwise indicate to the operator that the collection container is full. When the collection container is full, the device will shut down until the container is removed and replaced by an empty collection container. The device will then be able to resume shredding additional waste material for another fill cycle.

The micro-processor of the waste processing device includes different default programs that may be utilized in the operation of the device. For example, and only by way of illustration, a certain default setting determines how long the waste processing device will run during an individual shredding sequence. To accommodate a situation in which a waste material becomes jammed in the cutting members, the microprocessor may also be programmed to permit the shredding sequence to stop, run in reverse for a period of time (for example, about 3 second), and then commence rotating in forward direction again. The waste processing device may include a counter to determine how many items of waste material were shredded during the fill cycle of the sharps collection container.

The shredding process results in consolidation of sharps for safe, easy and cost-effective disposal. Following the shredding process, the same volume of non-shredded syringes that would typically fill (2) one gallon sharps disposal containers may be disposed of in one 2.7 liters sharps disposal container. Thus, the shredding process using the device of the present disclosure results in about a 5:1 space savings. The device eliminates handling risks and reduces the volume of the discarded medical sharps, syringes and needles into landfills.

Reducing the volume of medical sharps, discarded syringes and needles also increases the amount of syringes and needles that can be stored in a waste receptacle or sharps containers, thereby translating into substantial savings in handling fees, less land fill debris, less likelihood of handlers being pricked with needles, and prevents thieves from stealing the syringes and needles.

The certain illustrative embodiments of the device will be described in further detail with respect to the Figures. It should be noted that the device should not be limited to the illustrative embodiments depicted by the figures.

FIG. 1 is an exploded perspective view of the device 10. The device 10 includes an upper region 12 and a lower region 14 that is located below the upper region. The upper region 12 of the device 10 includes a top wall 16. The material intake member 18 is movably engaged with the top wall 16 of the housing. The material intake member 15 comprises an elongate member that extends horizontally along the top wall 16. The material intake member 18 comprises a cavity 20 for accepting medical waste to be processed. The material intake member 18 is opened and closed by an electric motor 20 housed in a motor housing 22 and affixed to the top 16 with a connecter 24.

Positioned between the lower portion of the material intake member 18 and the cutting members is an upper horizontal wall 30 that separates the material intake member 18 from the cutting members. The upper internal horizontal wall 30 includes an opening or chute 32 for transferring waste to be processed from the material intake member 18 to the cutting members located in the cutting region 34.

A lower horizontal internal wall 36 divides the upper 12 and lower regions 14 of the housing of the device 10. The lower horizontal wall 36 includes an opening or chute 38 to permit shredded medical waste to move from the cutting region 34 into the collection member 40 located in the lower region 14 of the housing. The lower collection region 14 of the housing includes a retractable tray 50 for carrying a collection member 40, such as a bio-hazard sharps container having a top 42 and lid 44. The retractable tray 10 is engaged with spaced-apart mounting rails 52 that permit the tray to slide into and out of the lower region 14 of the housing. The front wall 54 of the housing includes a handle 56 for retracting (pulling) and inserting (pushing) the tray 50 into the housing. The device 10 also includes a computer processor 60 which can set multiple defaults and additional features such as running time, troubleshooting error codes, if something were placed into the chamber that is not a needle or a syringe, such as a solid steel screwdriver, the machine would detect a foreign object, the lid will open and the error code will direct the user to remove the foreign object. The IR light emitting diode 70, LED lens 72, redundant push button 74 and power adapter 76 are positioned in 20 the top wall 16 of the device 10. The IR transmitter 77 is mounted on the side wall of the lower housing cover 15 of the device 10. The IR receiver 78 is mounted on the side wall of the lower housing cover 15 of the device 10 opposite the side of the IR transmitter 77.

Figure 2:
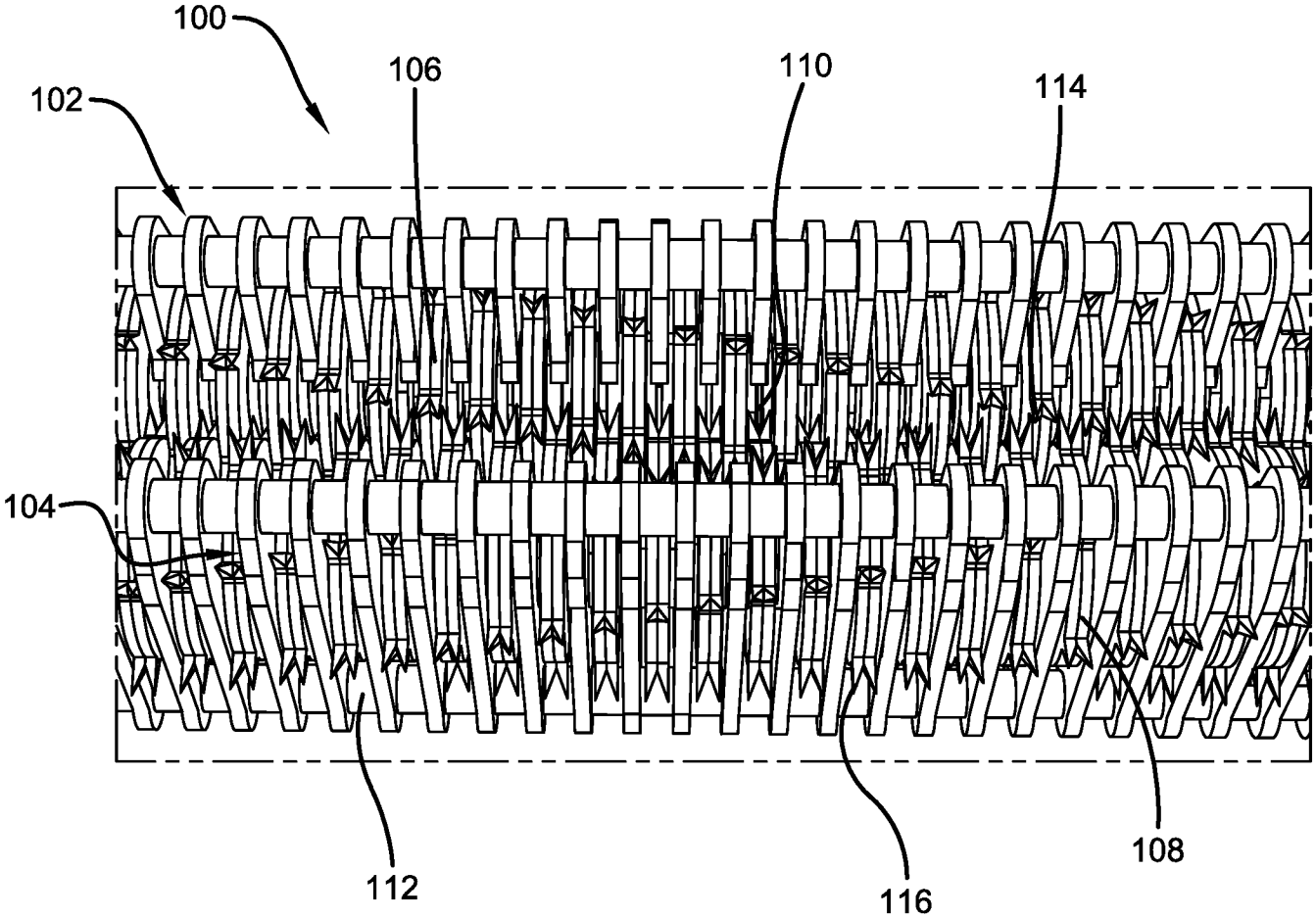
FIG. 2 is a perspective view of the cutting members of the waste processing device.

FIG. 2 is a top view of the cutting region of the waste processing device. Cutting region 100 includes cutting members 102, 104 that are positioned in the same horizontal plane. Each of cutting members 102, 104 includes a plurality of cutters 106, 108 that are mounted on a rotatable shaft 110, 112. Cutters 106, 108 are axially separated from the immediate axial cutter along the entire length of the cutting member 102, 104. Each of the cutting members 102, 104 also includes cutting teeth 114, 116. Cutting teeth 114, 116 of the cutters 106, 108 are positioned at different angles to the relative to the cutting teeth on immediate adjacent cutters 106, 108.

Figure 3:
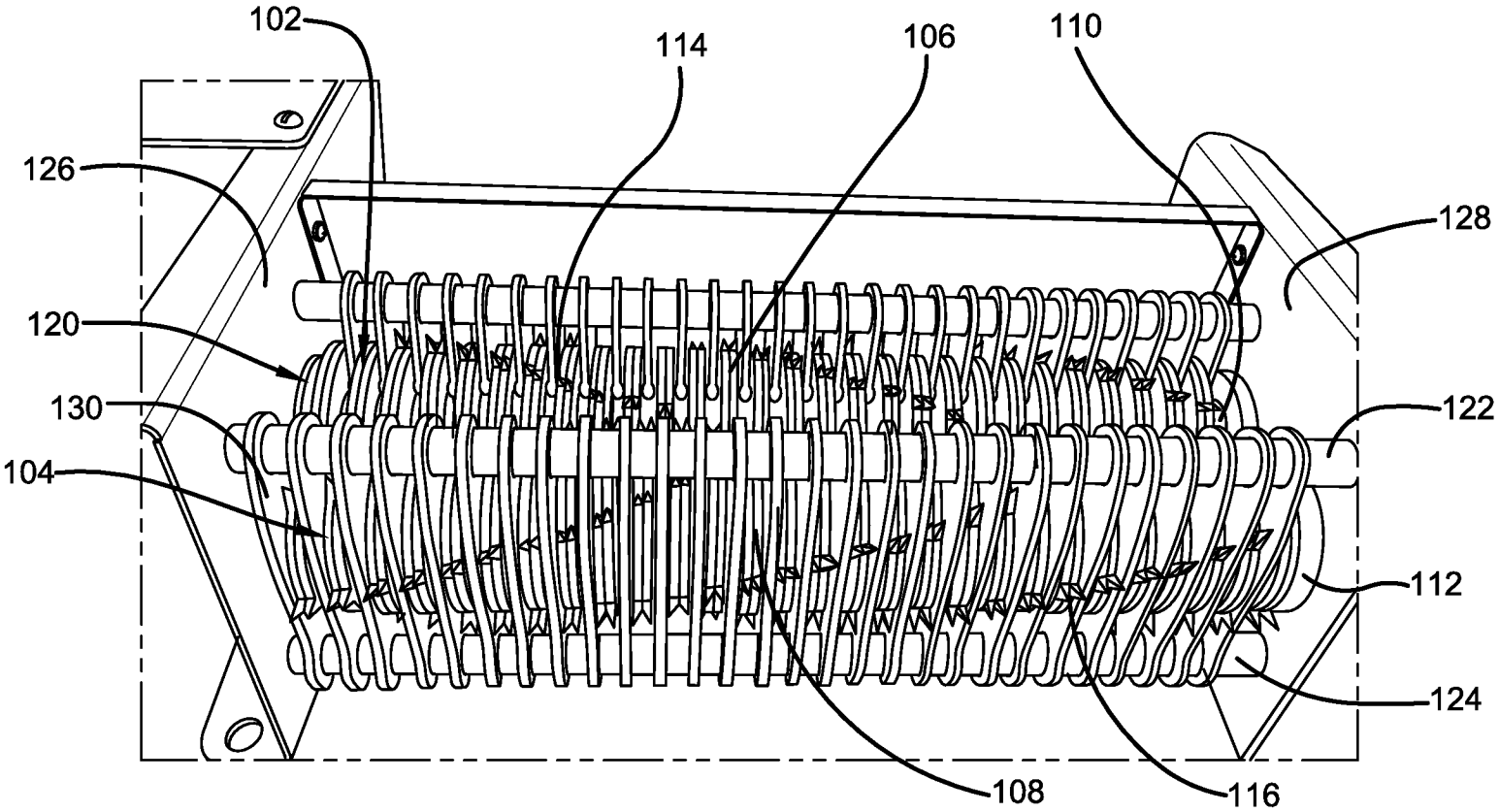
FIG. 3 is a perspective view of the cutting members of the waste processing device.

FIG. 3 is a perspective view of the cutting members of the device. Cutting members 102, 104 that are positioned in the same horizontal plane. Each of cutting members 102, 104 includes a plurality of cutters 106, 108 that are mounted on a rotatable shaft 110, 112. Cutters 106, 108 are axially separated from the immediate adjacent axial cutter along the entire length of the cutting member 102, 104. Each of the cutting members 102, 104 also includes cutting teeth 114, 116. Cutting teeth 114, 116 of the cutters 106, 108 form helical rows 120 of cutters extending along cutting members 102, 104. Upper 122 and lower 124 rails extend between side walls 126, 128. Upper rail 122 is positioned above cutting members 102, 104 and lower rail 124 is positioned below cutting members 102, 104. Spacers 130 are engaged with and supported by the upper 122 and lower 124 rails of the device. Spacers 130 provide axial spacing between cutters 106, 108 along the longitudinal axis of the cutting members.

The device is capable of shredding medical sharps, entire plastic syringes and needles, into tiny micro particles by inserting them into the material intake chamber of the device and allowing them to pass into the cutting region. The resulting shredded material is then deposited into a bio-hazard sharps container.

Obliteration of syringes and needles is a deterrent with respect to second hand use of infected medical products. Although there are federal guidelines for preventing theft of controlled substances in health care facilities, the theft of used syringes with respect to illegal intra-venous drug use is on the rise. Hospitals, nursing homes, medical clinics, health departments and pharmacies are reporting alarming rates of stolen syringes and needles. Moreover, thefts by health care workers are not uncommon, mainly because health care facilities (of physicians, physical therapists, advanced life support personnel, physician assistants, athletic trainers, occupational therapists, respiratory therapists, nurse practitioners, nurse midwives and dietitians) is where many popularly abused drugs are located.

It has been found that the device efficiently shreds needles metals and plastic in a few seconds. After medical practitioners have administered injections, the needle and syringe can together be placed into the device for obliteration, eliminating any second-hand use and stick injuries. In particular, the needles and/or other shredded material(s) may be rendered unrecognizable. Other devices utilize electricity to destroy the needle or the sharp without affecting the syringe or casing. However, the resulting air particulates that are emitted is an environmental risk and improper disposal of the remaining product often times is disposed of improperly. Conversely, the disclosed device destroys the syringe and renders the needle or the sharp unusable without the concern of any potentially harmful aerosols that may be emitted during its operation.

The waste processing device is also capable of effectively shredding diabetic lancets, razors and blades, butterfly and hoses. In addition to the use of the device in healthcare and medical institutional settings, the waste processing device may be used by law enforcement personnel to prevent detainees or inmates from using razors and blades in municipal, state, and/or federal detention centers, prisons or jails. Shredding these materials prevents inmates from using dangerous needles, blades and razors in physical attacks on law enforcement personnel, other inmates, or facilities.

While the waste disposal device and method for reducing the volume of waste material has been described in connection with various illustrative embodiments, as shown in the Figures, it is to be understood that other similar embodiments may be used or modifications and additions may be made to the described embodiments for performing the same functions. Therefore, the shredding device and method for reducing the volume of waste material should not be limited to any single embodiment, but rather construed in breadth and scope in accordance with the recitation of the appended claims.

Figure 4:
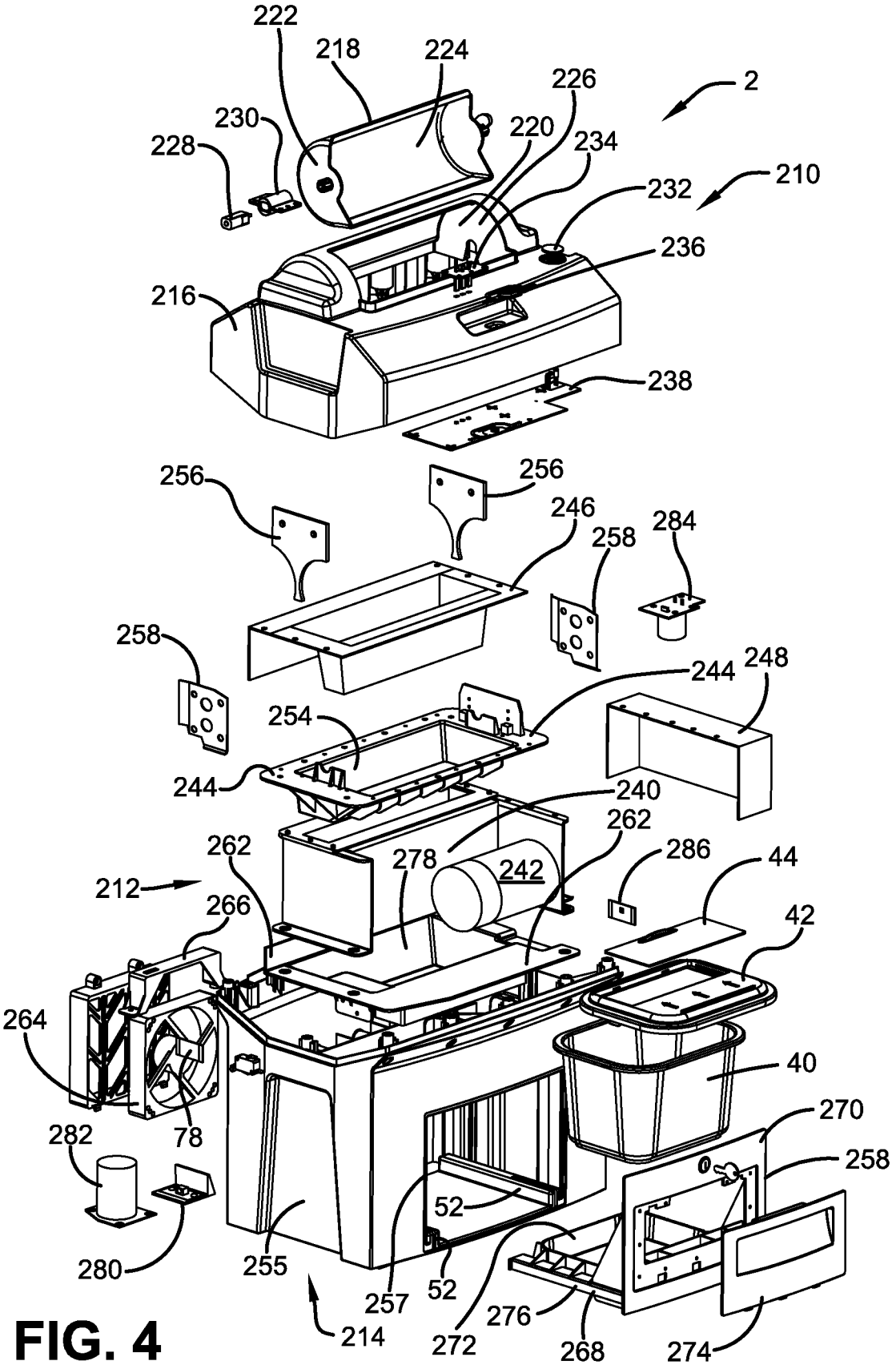
FIG. 4 is an exploded perspective view of a waste destruction device.
Figure 5:
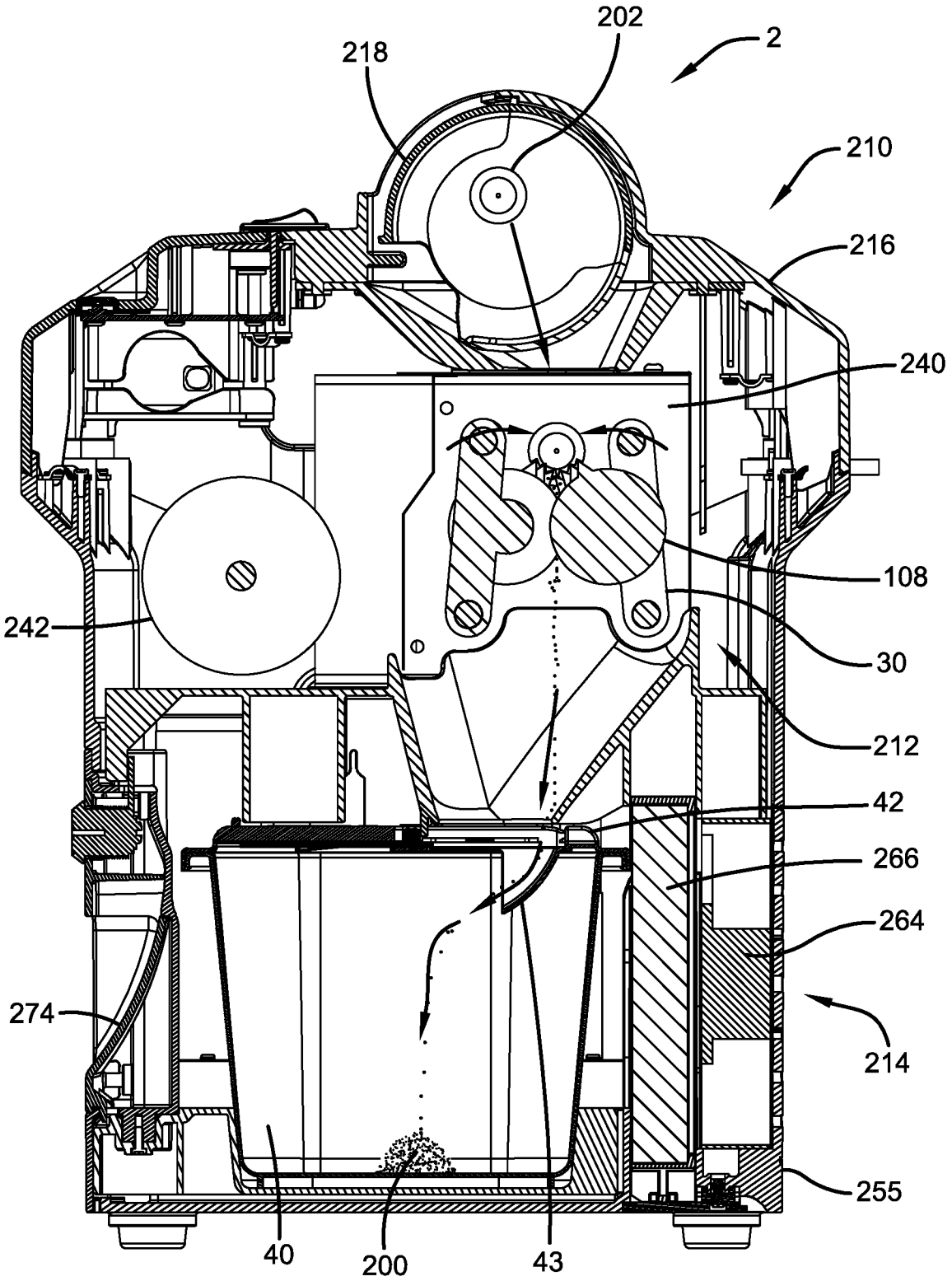
FIG. 5 is a cross sectional view of a waste destruction device.

With reference to FIGS. 4-5, a waste destruction device 2 preferably includes a material intake member 210, a destruction device 212 and a storage member 214. The material intake member 210 includes an intake housing 216 and an intake cover 218. A cover opening 220 is formed through the intake housing 216 and is sized to receive the intake cover 218. The intake cover 218 includes a semi-circular shape and two end walls 222, which forms an internal cavity 224. The two end walls 222 of the intake cover 218 are pivotally engaged with two opening end walls 226 of the cover opening 220. The intake cover 218 completely covers the cover opening 220 in a closed orientation. The intake cover 218 in an open orientation allows sharps, needles and solid waste (waste 200) to drop through the cover opening 220 into the destruction device 212. A motor 228 is retained in a motor case 230. The motor case 230 is mounted behind one of the two opening end walls 226 of the cover opening 220 to pivot the intake cover 218 from the open orientation to the closed orientation. A touch less switch 232 utilizes an IR light emitting diode. An LED housing 234 provides status of whether the machine is ready; a solid waste container is full; and if there is an error. If an operational problem occurs, the error will have a set number of flashes to indicate the type of error, problem or failure. The type of error may also be wirelessly transmitted. A push button 236 enables a rotational direction of first and second cutter members 102, 104 to be reversed.

At least one microprocessor board 238 is used to control devices of the waste destruction device 2. The microprocessor board 238 can set multiple defaults and additional features such as running time, troubleshooting error codes, if something were placed into the cover opening 220 that would damage the first and second cutting members 102, 104. The microprocessor board 238 also back-up systems that can override a touchless system, an on/off switch, a reversing cutter motor function, a full container function, a servicing indication, a factory reset and cleaning alert. The microprocessor board 238 also includes a timer system for a desired function, which can be set by date, time, duration and intervals to accomplish a task, such as disinfection, cleaning, servicing, lock-out from an outside by an electronic system.

The waste destruction device 2 also preferably includes a wireless function to allow an end user via desktop, tablet, smart phone or watch, such as by electronic means using a Unique Device Identifier to signal a designated individual or entity that the container needs changing, or the machine needs servicing, disinfecting and is out of operation, or foreign object entered into machine. The waste destruction device 2 preferably includes automatic shut off after non-use based on entities hours, weekends or during holidays or non-opening days that the device isn't continually left on and to save components as well as for safety.

Figure 6:
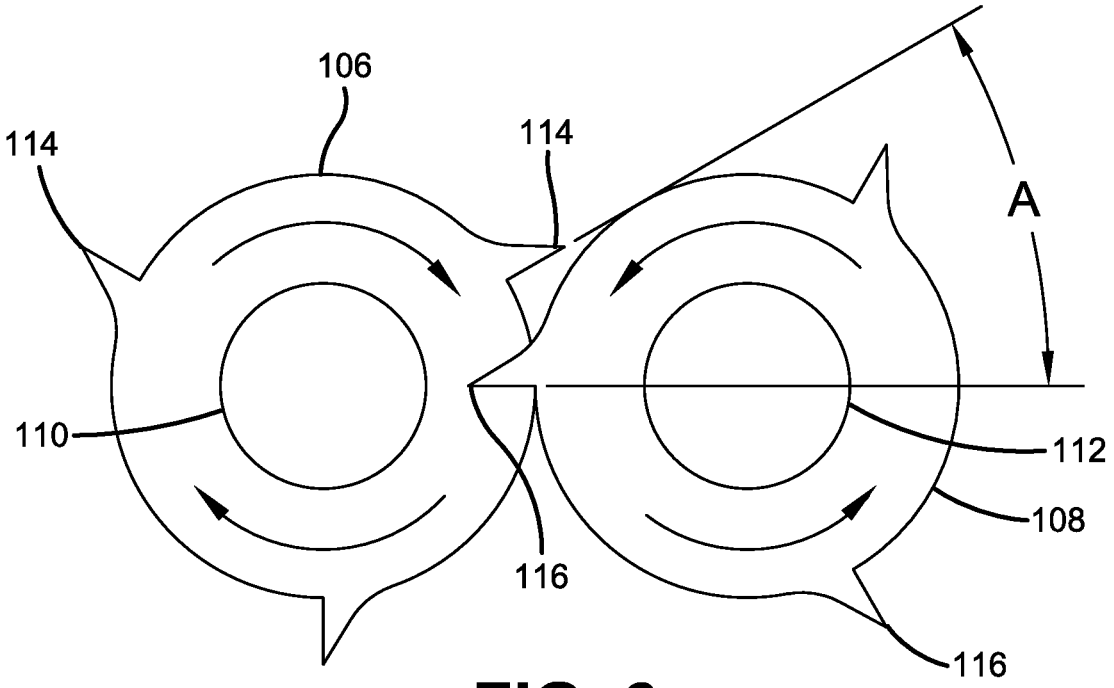
FIG. 6 is an end view of first and second cutters with first and second teeth oriented at an angle "A."
Figure 7:
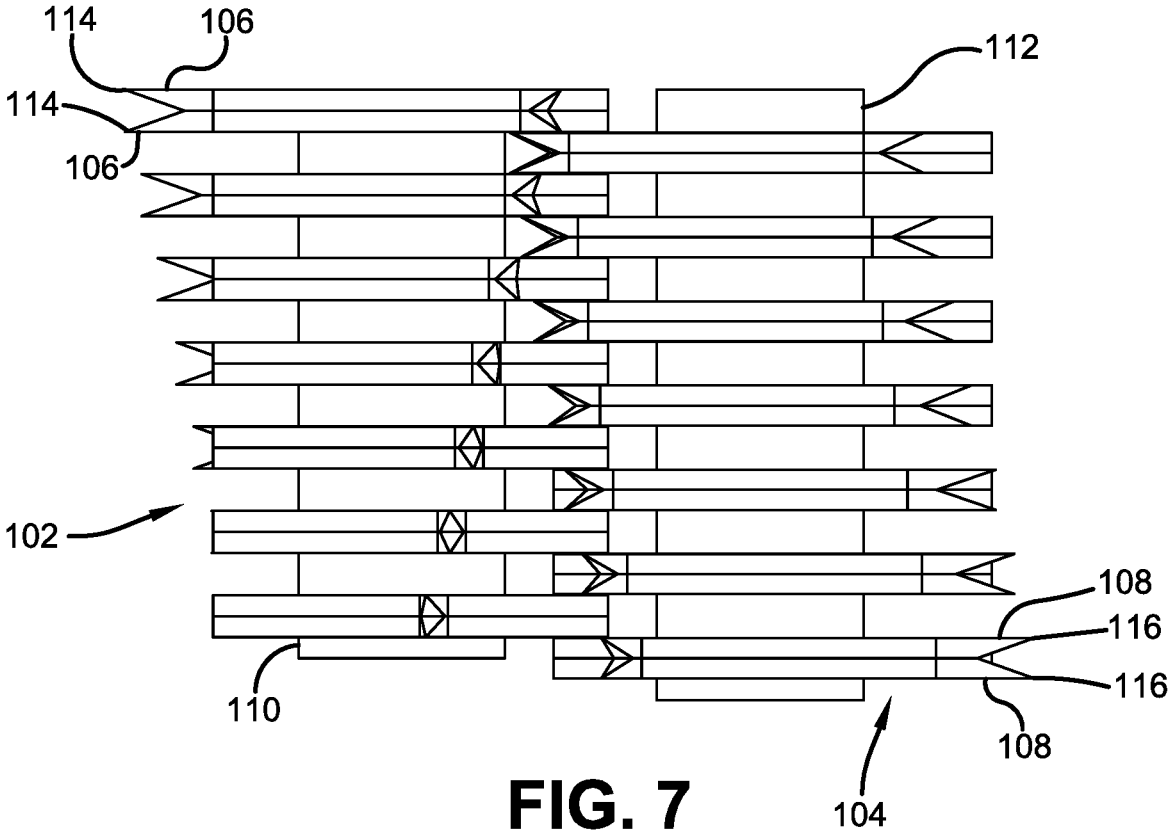
FIG. 7 is a top view of a plurality of first and second cutters engaged with each other without showing a plurality of spacers.

With reference to FIGS. 2-3, the destruction device 212 preferably includes a cutter housing 240, the first cutter member 102, the second cutter member 104, a cutter motor 242, a cutter intake housing 244, a cutter intake shield 246 and a gear shield 248. The cutter housing 240 rotatably retains each end of the first and second cutter members 102, 104. With reference to FIGS. 6-7, the first cutter member 102 includes a plurality of first cutters 106 retained on a first shaft 110. However, the plurality of first cutters 106 and the first shaft 110 may be fabricated from a single piece of material. The second cutter member 104 includes a plurality of second cutters 108 retained on a second shaft 112. However, the plurality of second cutters 108 and the second shaft 112 may be fabricated from a single of material. The first and second cutters 106, 108 are axially separated from the immediate adjacent axial cutter along the entire length of the cutting members 102, 104.

Figure 8:
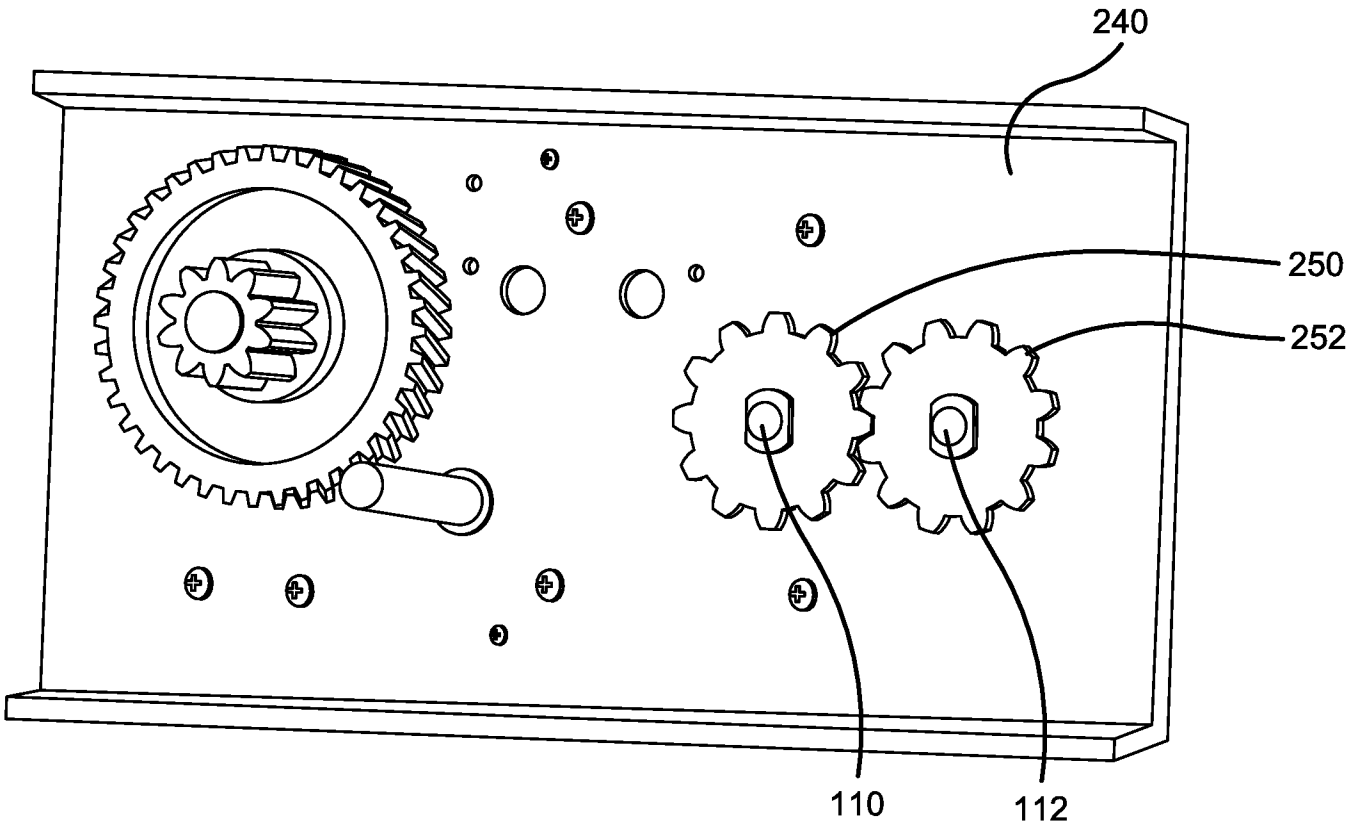
FIG. 8 is an end view of a first gear retained on a first shaft and a second gear retained on a second shaft for orienting first cutting teeth of a first cutter with second cutting teeth of a second cutter with other gears of a gear train removed.

The first and second cutters 106, 108 also include cutting teeth 114, 116, respectively. The first and second cutting teeth 114, 116 are preferably arranged to form a fork as shown in FIG. 7. Cutting teeth 114, 116 of the first and second cutters 106, 108 form helical rows 120 extending along a length of the first and second cutting members 102, 104. With reference to FIG. 8, a cutting angle "A" between the first cutting teeth 114 and the second cutting teeth 116 may be changed. A first gear 250 is retained on the first shaft 110 and a second gear 252 is retained on the second shaft 112. The second gear 252 is removed from the second shaft 112 and the second shaft 112 is rotated to create to create a different cutting angle "A".

Figure 7A:
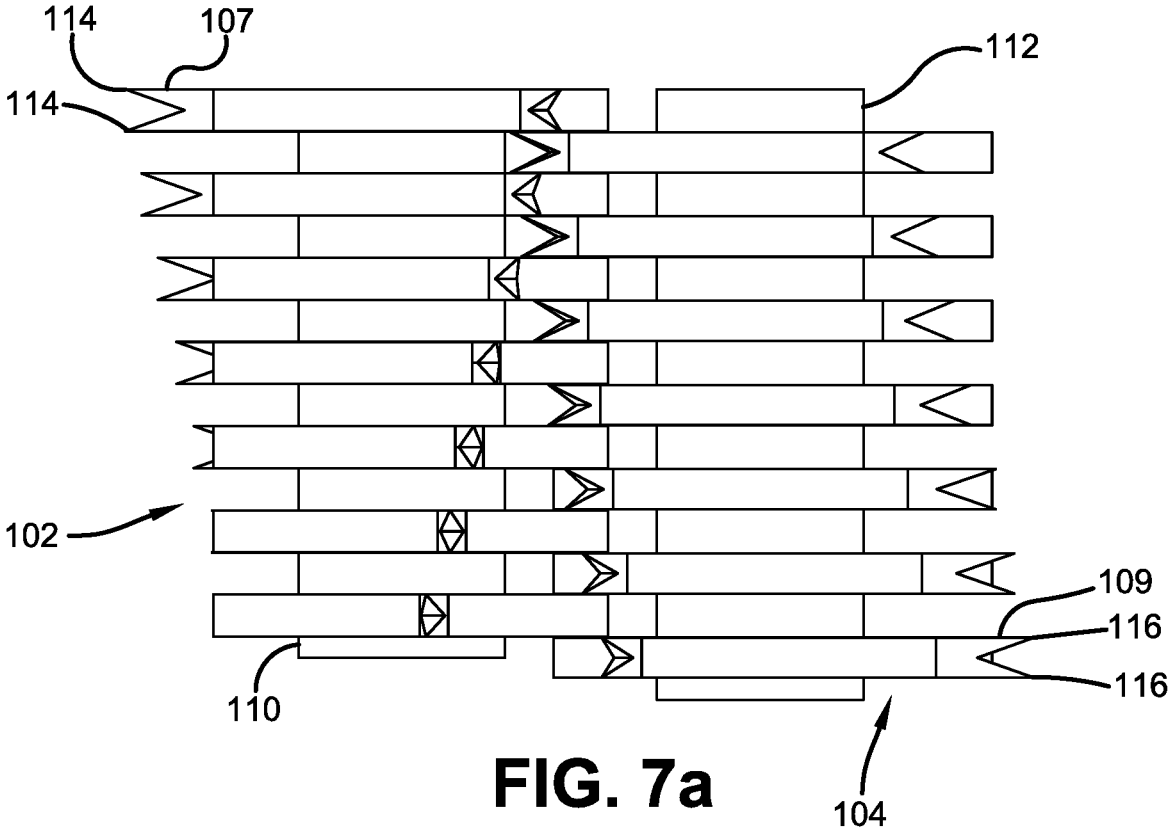
FIG. 7*a* is a top view of a first cutting member fabricated from a single piece of material and a second cutting member fabricated from a single piece of material.
Figure 7B:
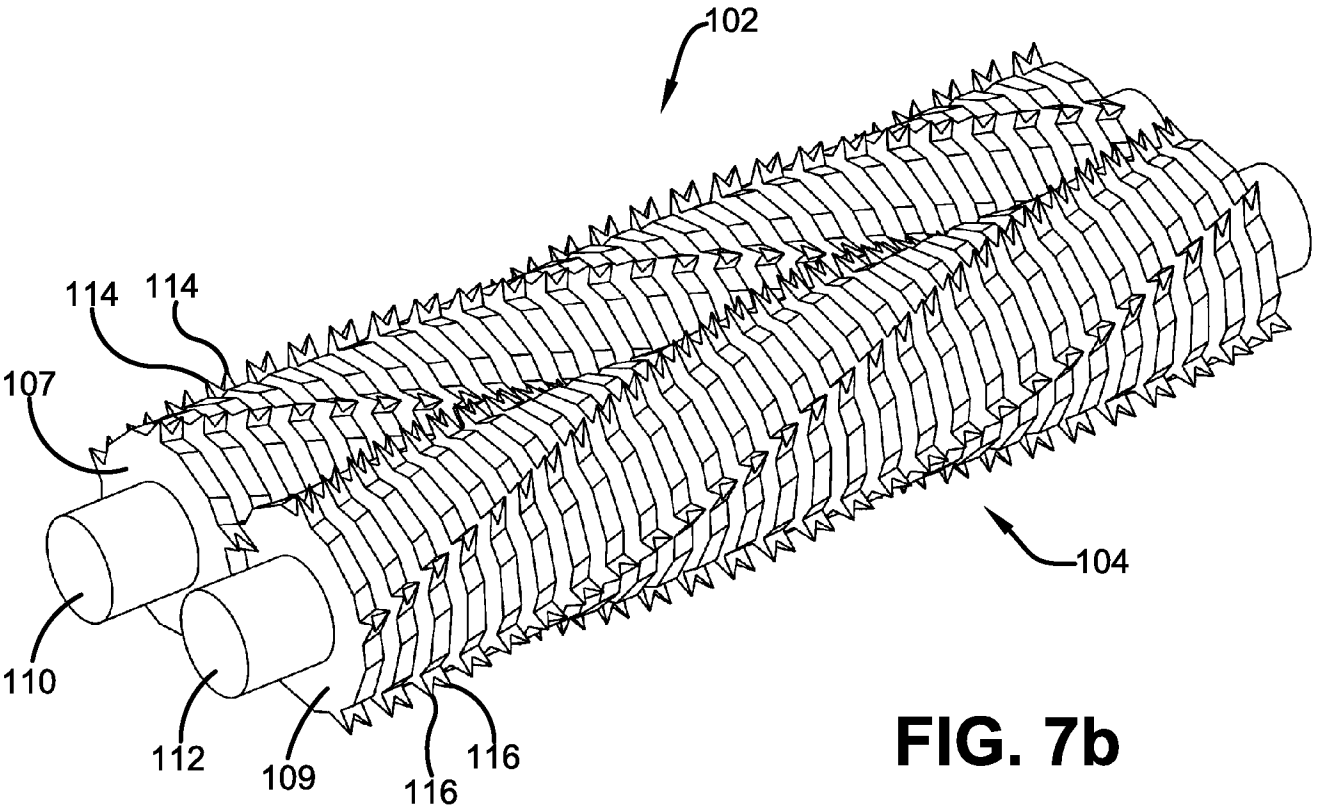
FIG. 7*b* is a perspective view of a first cutting member fabricated from a single piece of material and a second cutting member fabricated from a single piece of material.

With reference to FIGS. 7*a*-7*b*, the first and second cutters 102, 104 are shown as fabricated from a single piece of material. Two adjacent first cutters 106 become a single first cutter 107. The plurality of first cutters 107 and the first shaft 110 are fabricated from a single piece of material. Two adjacent second cutters 108 become a single second cutter 109. The plurality of second cutters 109 and the second shaft 112 are fabricated from a single piece of material.

A pair of upper rails 122 are disposed above and outside of the first and second cutter members 102, 104. A pair of lower rails 124 are disposed below and outside of the first and second cutter members 102, 104. Each end of the pair of upper and lower rails 124 are retained in the cutter housing 240. Each end of a plurality of spacers 130 are engaged with the pair of upper and lower rails 122, 124. The plurality of spacers 130 provide axial spacing between the cutters 106, 108 along an axis of the first and second shafts 110, 112. A housing of the cutter motor 242 is secured to the cutter housing 240. A drive shaft of the cutter motor 242 rotates a gear train (partially shown in FIG. 8) to rotate the first and second shafts 110, 112. The cutter intake housing 244 includes an intake chute 254 to guide waste 200 into the first and second cutter members 102, 104. The intake chute is inserted into the cutter housing 240. The cutter intake shield 246 in conjunction with a pair of shaft gap covers 256 and a pair of cover spacers 258 prevent the waste 200 from escaping around a perimeter of the first and second cutting members without being shredded. The gear shield 248 is used to cover the gear train for safety. The waste destruction device 2 includes electrical circuitry for operation of the motors and PC boards in any country in the world. However, the waste destruction device 2 could also be powered by a battery, solar and USB.

The storage member 214 preferably includes a storage housing 255, a container drawer 258, the waste container 40, a destruction device mount 262, a fan 264 and a filter 266. The filter 266 is preferably a HEPA filter. The storage housing 255 includes a drawer opening 257 and a pair of draw guides 52. The container drawer 258 includes a base member 268, a front member 270, a container retaining boss 272 and a handle insert 274. The front member 270 extends upward from a front edge of the base member 268. The retaining boss 272 extends upward from the base member 268. An inside perimeter of the retaining boss 272 is sized to receive the waste container 40. The handle insert 274 is secured to a front of the front member 270. A pair of bottom rails 276 are retained on opposing bottom edges of the bottom member 268. The pair of bottom rails 276 are sized to be slidably received by the pair of draw guides 52. The destruction device mount 262 includes a chute 278 for guiding waste 200 into the waste container 40. The cutter housing 240 is attached to a top of the destruction device mount 262. The waste container 40 is fabricated out of a material that allows light to penetrate there through. With reference FIG. 5, the top 42 of the waste container 40 preferably includes a ramp 43 for evenly distributing the shredded waste 200 into the waste container 40. An infrared emitter 280 and an emitter actuator 282 are retained inside the storage housing 256 at one end. An infrared receiver 284 and a receiver actuator 286 are retained inside the storage housing 256 at an opposing end. The height of the infrared emitter 280 and the infrared receiver 284 are adjusted with the emitter actuator 282 and the receiver actuator 286, respectively. The infrared emitter 280 emits light through the waste container 40 to ensure it is not full.

Figure 9:
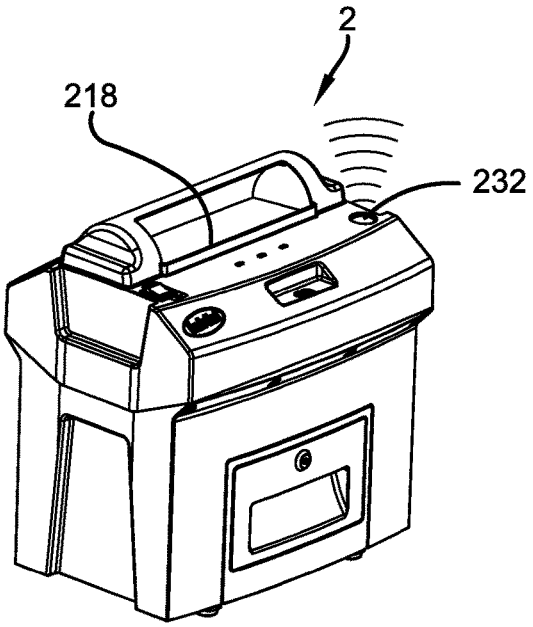
FIG. 9 is a perspective view of a waste destruction device ready for loading two syringes.
Figure 10:
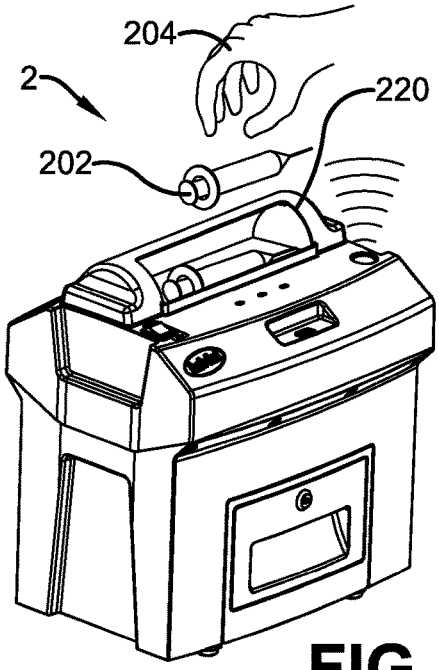
FIG. 10 is a perspective view of a waste destruction device with a syringe being deposited into a cover opening.
Figure 11:
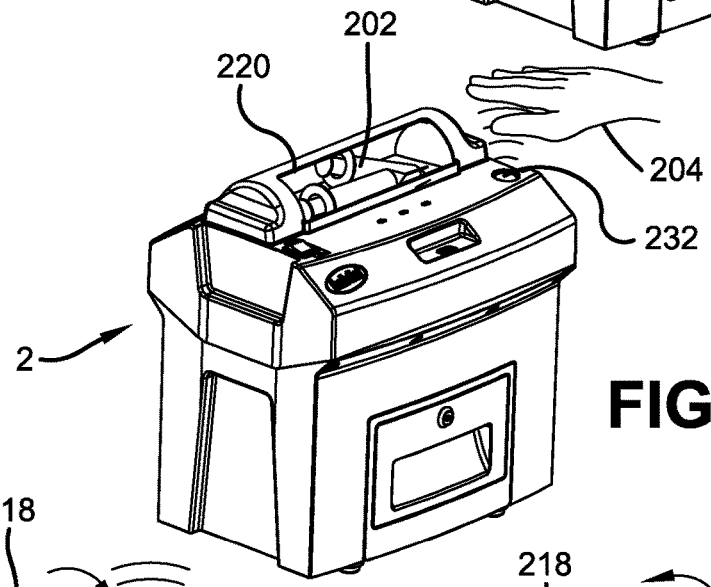
FIG. 11 is a perspective view of a user waving their hand over a touch less switch of a waste destruction device to close the intake cover.
Figure 12:
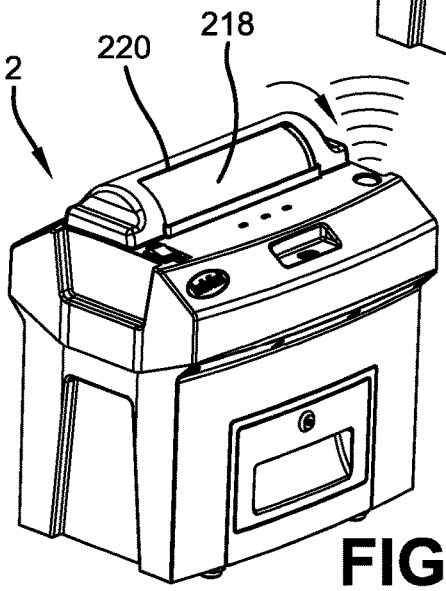
FIG. 12 is a perspective view of a waste destruction device with a closed intake cover and the two [only two are shown] syringes therein being shredded by first and second cutting members.
Figure 13:
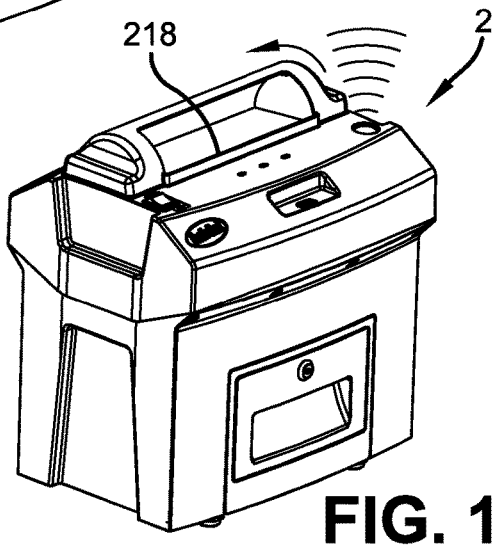
FIG. 13 is a perspective view of a waste destruction device having shredded two syringes and opening an intake cover to receive more sharps, needles and solid waste.

An intake cover 218 is open to receive several syringes 202 in FIG. 9. The user deposits two [the drawing only shows two syringes] syringes 202 into the cover opening 220 in FIG. 10. The user waves their hand 204 over the touch less switch 232 to close the intake cover 218 in FIG. 11. The intake cover 218 closes in FIG. 12 and the two syringes 202 are shredded by the first and second cutting members 102, 104 in FIG. 12. The intake cover 218 opens up, after the two syringes 202 are shredded in FIG. 13.

Figure 14:
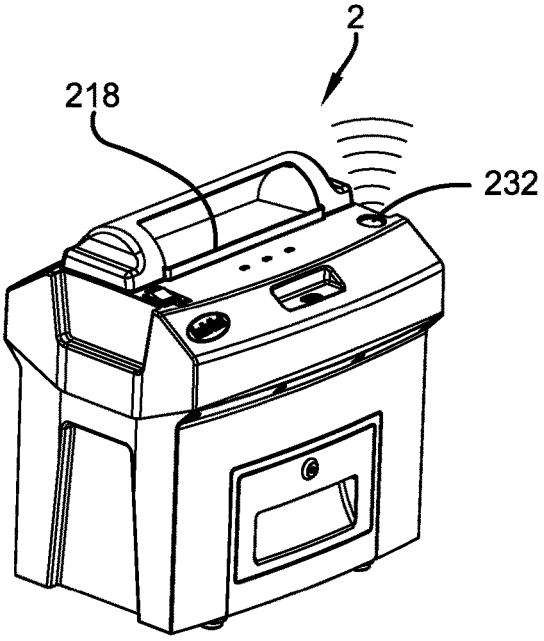
FIG. 14 is a perspective view of a waste destruction device ready for loading two disposable razors.
Figure 15:
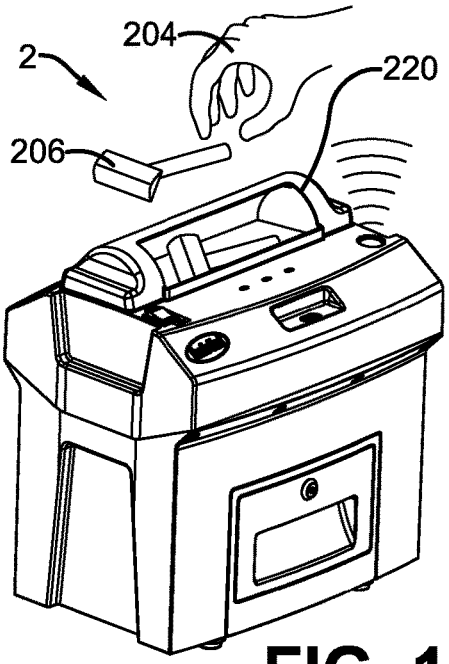
FIG. 15 is a perspective view of a waste destruction device with a disposable razor being deposited into a cover opening.
Figure 16:
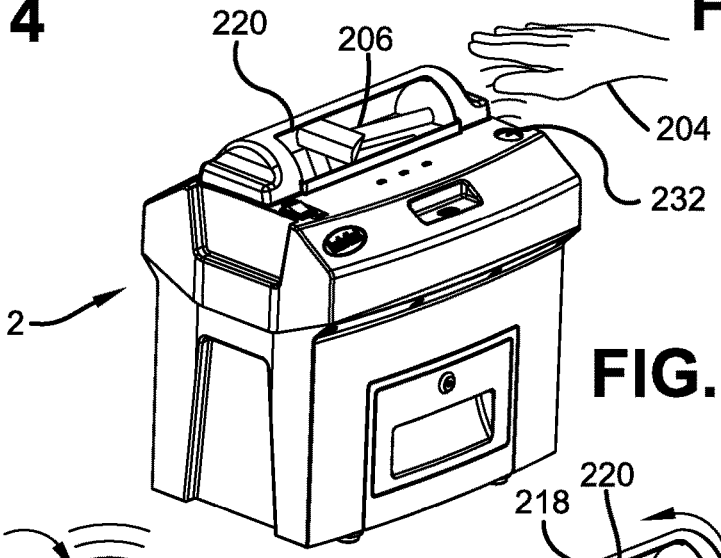
FIG. 16 is a perspective view of a user waving their hand over a touch less switch of a waste destruction device to close the intake cover.
Figure 17:
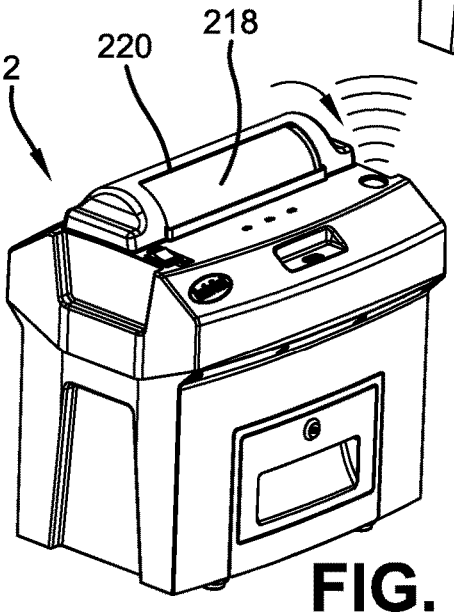
FIG. 17 is a perspective view of a waste destruction device with a closed intake cover and the two disposable razors therein being shredded by first and second cutting members.
Figure 18:
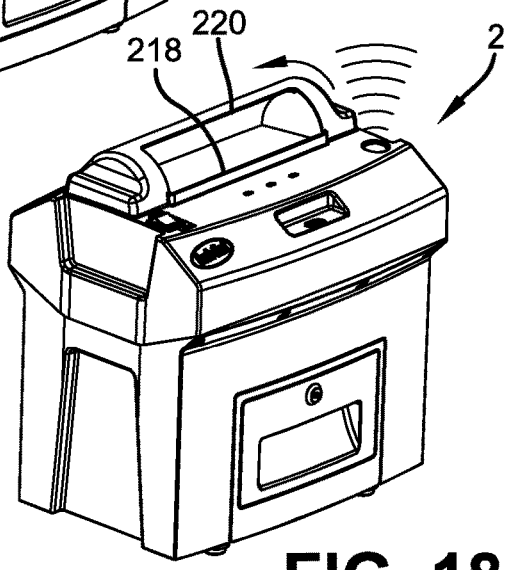
FIG. 18 is a perspective view of a waste destruction device having shredded two disposable razors and opening an intake cover to receive more sharps, needles and solid waste.

An intake cover 218 is open to receive several disposable razors 206 in FIG. 14. A user deposits two disposable razors 206 into the cover opening 220 in FIG. 15. The user waves their hand 204 over the touch less switch 232 to close the intake cover 218 in FIG. 16. The intake cover 218 closes in FIG. 17 and the two disposable razors 206 are shredded by the first and second cutting members 102, 104 in FIG. 17. The intake cover 218 opens up, after the two disposable razors 22 [not limited to just two} are cut-up in FIG. 18.

Figure 19:
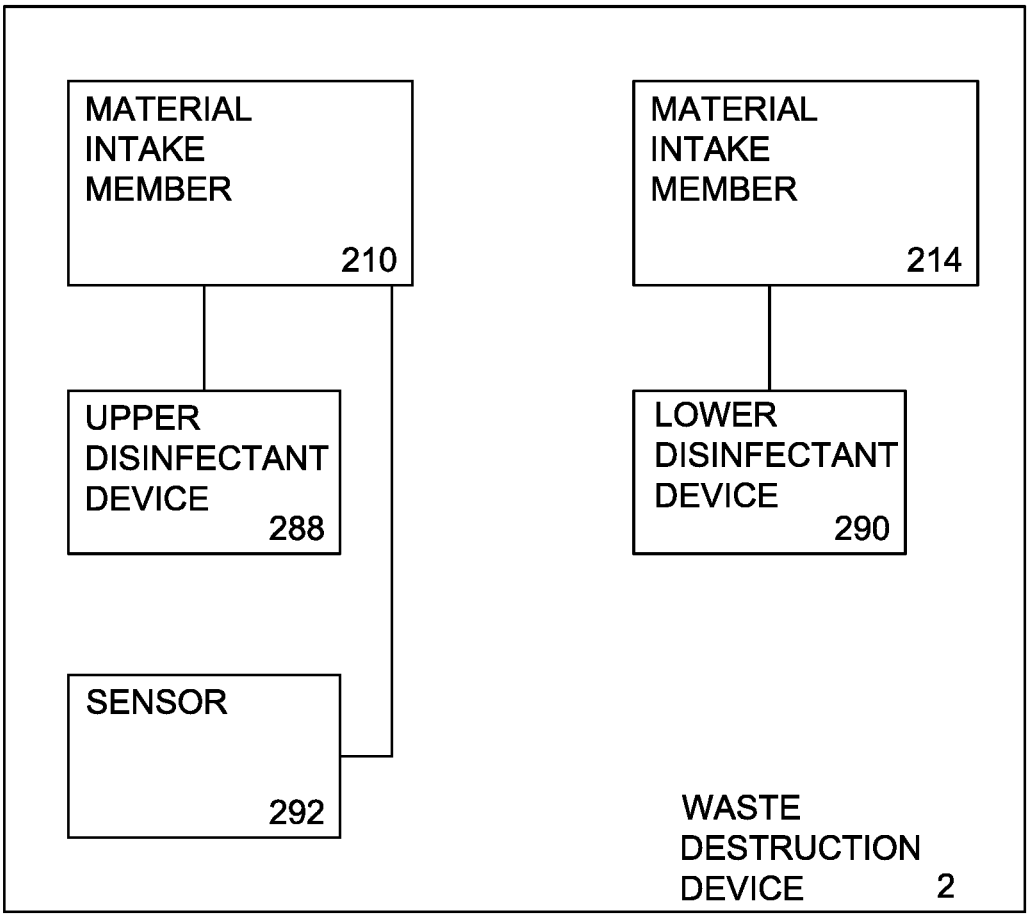
FIG. 19 is a schematic diagram of a waste destruction device having a material intake member with an upper disinfectant device and a sensor, and a storage member having a lower disinfectant device.

With reference to FIG. 19 an upper disinfectant device 288 is located in the material intake member 210 and a lower disinfectant device 290 is located in the storage member 214. The disinfectant devices 288, 290 could dispense a liquid, a powder, a gas UV/LED light, a chemical or any other suitable disinfectant. The upper and lower dispensers 288, 290 may be operated automatically or manually. A sensor 292 may be located in the material intake member 210 to sense a foreign object that does not belong in the cover opening 220, such as a large steel object. If a foreign object is sensed, the intake cover 218 opens and an error code directs the user to remove the foreign object. The waste destruction device 2 can rest on a counter or cart; be mounted on a wall, be mounted in an ambulance, utilize small spacing requirements; and can be easily carried to a new location.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A waste destruction device comprising:

a material intake member includes an intake housing and an intake cover, said intake cover pivots in said intake housing, wherein at least one object to be shredded is placed in said intake housing when said intake cover is in an open position, said intake cover is closed when the at least one object is shredded;

a destruction device includes a pair of counter-rotational cutting members, said destruction device is located below said material intake member;

a device for rotating said pair of counter-rotating cutting members;

a microprocessor board includes a timer system for setting a lock-out to prevent further shredding based on a number of shredding cycles until said cutting members are cleaned; and a collection member is located below said destruction device, wherein said collection member receives the at least one object shredded by said destruction device.

2. The waste destruction device of claim 1, further comprising:

a sensor for activating the opening and closing of said material intake member.

3. A waste destruction device comprising:

a material intake member includes an intake housing and an intake cover, said intake cover pivots in said intake housing, wherein at least one object to be shredded is placed in said intake housing when said intake cover is in an open position, said intake cover is closed when the at least one object is shredded;

a destruction device includes two counter-rotating cutting members, said destruction device is located below said material intake member;

a device for rotating said pair of counter-rotating cutting members;

a collection member is located below said destruction device, wherein said collection member receives at least one object placed in said material intake member and shredded by said destruction device;

a touch less sensor for closing said intake cover, said pair of counter-rotating cutting members will not rotate, until said intake cover is in a closed position, said touch less sensor activates a cover device to pivot said intake cover to said closed position for rotating said counter-rotating cutting members; and a microcontroller board is capable of controlling said touchless system.

4. The waste destruction device of claim 2 wherein:

a drawer includes a base member and a front member, a bottom of said front member extends upward from a front edge of said base member, said base member is structured to receive said collection member, said collection member does not move laterally relative to said base member.

5. The waste destruction device of claim 1 wherein:

said microprocessor board includes a timer system for setting a desired date and duration for disinfecting an inside of said waste destruction device.

6. The waste destruction device of claim 3 wherein:

said microprocessor is capable of controlling a full container function for indicating that said collection member is full.

7. The waste destruction device of claim 3 wherein:

said microprocessor is capable of controlling a servicing indication for showing when said waste destruction device needs to be serviced or cleaned.

8. The waste destruction device of claim 3 wherein:

said touch less sensor activates said cover device to pivot said intake cover to an open position when said counter-rotating cutting members stop rotating.

9. A waste destruction device comprising:

a material intake member includes an intake housing and an intake cover, said intake cover pivots in said intake housing, wherein at least one object to be shredded is placed in said intake housing when said intake cover is in an open position, said intake cover is closed when the at least one object is shredded;

a destruction device includes two counter-rotating cutting members, said destruction device is located below said material intake member;

a device for rotating said pair of counter-rotating cutting members;

a collection member is located below said destruction device, wherein said collection member receives at least one object placed in said material intake member and shredded by said destruction device; and a microprocessor includes a timer for dispensing a disinfection substance on to said counter-rotating cutter members after a set number of rotations thereof.

10. The waste destruction device of claim 9 wherein:

each one of said two counter-rotating cutting members are machined from a single piece of material.

11. The waste destruction device of claim 9 wherein:

said microprocessor is capable of controlling a full container function for indicating that said collection member is full.

12. The waste destruction device of claim 9 wherein:

said microprocessor is capable of controlling a servicing indication for showing when said waste destruction device needs to be serviced or cleaned.

13. The waste destruction device of claim 9 wherein:

said touch less sensor activates said cover device to pivot said intake cover to an open position when said counter-rotating cutting members stop rotating.

14. The waste destruction device of claim 9 wherein:

said microprocessor board includes a timer system for setting a desired date and duration for disinfecting an inside of said waste destruction device.

* * * * *